US006237923B1

(12) United States Patent
Fowle

(10) Patent No.: US 6,237,923 B1
(45) Date of Patent: May 29, 2001

(54) SKATE

(76) Inventor: Roger Fowle, 1 Lyons Street, Cottesloe, Western Australia, 6011 (AU)

( * ) Notice: Subject to any disclaimer, the term of this patent is extended or adjusted under 35 U.S.C. 154(b) by 0 days.

(21) Appl. No.: 09/336,273

(22) Filed: Jun. 18, 1999

(51) Int. Cl.[7] ..... A63C 1/00

(52) U.S. Cl. ..... 280/11.115; 280/11.224; 280/11.233

(58) Field of Search ..... 280/11.224, 11.221, 280/11.19, 11.24, 11.232, 11.233, 11.115, 11.16, 11.26, 11.223, 11.227, 11.201

(56) References Cited

U.S. PATENT DOCUMENTS

| | | | | |
|---|---|---|---|---|
| 674,096 | * | 5/1901 | Pease | 280/11.115 |
| 732,120 | * | 6/1903 | Schmidt | 280/11.115 |
| 833,100 | * | 10/1906 | Wells | 280/11.115 |
| 834,526 | * | 10/1906 | Jones | 280/11.115 |
| 942,333 | * | 12/1909 | Lennox | 280/11.115 |
| 999,660 | * | 8/1911 | Koppel | 280/11.115 |
| 1,164,798 | * | 12/1915 | Felley | 280/11.115 |
| 1,241,607 | * | 10/1917 | Bowen | 280/11.115 |
| 1,924,948 | * | 8/1933 | Lieberenz | 280/11.115 |
| 4,445,698 | | 5/1984 | Stillwell . | |
| 4,451,055 | | 5/1984 | Lee . | |
| 4,691,931 | | 9/1987 | Vincent . | |
| 5,056,802 | | 10/1991 | Piotrowski . | |
| 5,492,345 | | 2/1996 | Kruczek . | |

FOREIGN PATENT DOCUMENTS

| | | | |
|---|---|---|---|
| 258281 | * | 4/1913 | (DE) . |
| 26 59 294 A1 | | 7/1978 | (DE) . |
| 31 31 049 A1 | | 2/1983 | (DE) . |
| 33 15 856 A1 | | 10/1984 | (DE) . |
| 33 11 759 A1 | | 11/1984 | (DE) . |
| 37 30 839 A1 | | 3/1989 | (DE) . |

* cited by examiner

*Primary Examiner*—Brian L. Johnson
*Assistant Examiner*—Bryan Fischmann
(74) *Attorney, Agent, or Firm*—Christie, Parker & Hale, LLP

(57) ABSTRACT

A skate (10) is provided which includes a boot portion having a base portion (14) and a boot (12), a first member (42) pivotably connected at an upper longitudinal end thereof to the base portion (14), a second member (44) pivotably connected at an upper longitudinal end thereof to the base portion (14) and pivotably connected to the first member (42), a first wheel (16) mounted on the first member (42) at a lower longitudinal end thereof, a drive wheel (18) mounted on the second member (44) at a lower longitudinal end thereof, the drive wheel (18) having a concentrically mounted pinion (53), and an elongate driving mechanism (46) pivotably connected to the boot portion and adapted to operatively engage with the pinion (53). The skate (10) is movable between an expanded configuration wherein the base portion (14) is spaced from the first wheel (16) and the drive wheel (18) and a contracted configuration wherein the base portion (14) is adjacent the first wheel (16) and the drive wheel (18). The arrangement is such that when the skate (10) moves from the expanded configuration to the contracted configuration, the angle between the base portion (14) and a plane passing through the axes of rotation of the first wheel (16) and the drive wheel (18) remains substantially constant and the driving mechanism (46) effects rotation of the pinion (53) and thereby transfers a propulsion force to the drive wheel (18).

26 Claims, 9 Drawing Sheets

90
92
64
14
94
44
42
16
100
96
62
60
98
50
18
72
68
54
56
70
46
48
52

92
120
14
110
52
64
106
44
62
108
104
126
130
128
124
60
18
122
16

92
120
14
106
110
62
44
64
52
108
104
130
126
124
128
60
18
122
16

132
92
52
14
64
116
114
62
44
126
130
128
124
60
18
122
16

132
92
64
52
14
116
62
44
114
130
126
124
128
60
18
122
16

SKATE

BRIEF DESCRIPTION OF THE INVENTION

The present invention relates to a skate with a propulsion means.

FIELD OF THE INVENTION

Known roller skates (or in-line skates) rely on a conventional propulsion action to propel the skates and a user in a given direction, this action involving a conventional shifting of weight between legs of the user.

The present invention seeks to provide a skate which at least assists in the propulsion of the user and the skate.

SUMMARY OF THE PRESENT INVENTION

In accordance with a first aspect of the present invention there is provided a skate including a boot portion having a base portion and a boot, a first member pivotably connected at an upper longitudinal end thereof to the base portion, a second member pivotably connected at an upper longitudinal end thereof to the base portion and pivotably connected to the first member, a first wheel mounted on the first member at a lower longitudinal end thereof, a drive wheel mounted on the second member at a lower longitudinal end thereof, the drive wheel having a concentrically mounted pinion, and an elongate driving mechanism pivotably connected to the boot portion and adapted to operatively engage with the pinion, the skate being movable between an expanded configuration wherein the base portion is spaced from the first wheel and the drive wheel and a contracted configuration wherein the base portion is adjacent the first wheel and the drive wheel, the arrangement being such that when the skate moves from the expanded configuration to the contracted configuration, the angle between the base portion and a plane passing through the axes of rotation of the first wheel and the drive wheel remains substantially constant and the driving mechanism effects rotation of the pinion and thereby transfers a propulsion force to the drive wheel.

BRIEF DESCRIPTION OF THE DRAWINGS

The present invention will now be described, by way of example, with reference to the accompanying drawings, in which.

DESCRIPTION OF THE INVENTION

Figure 1:
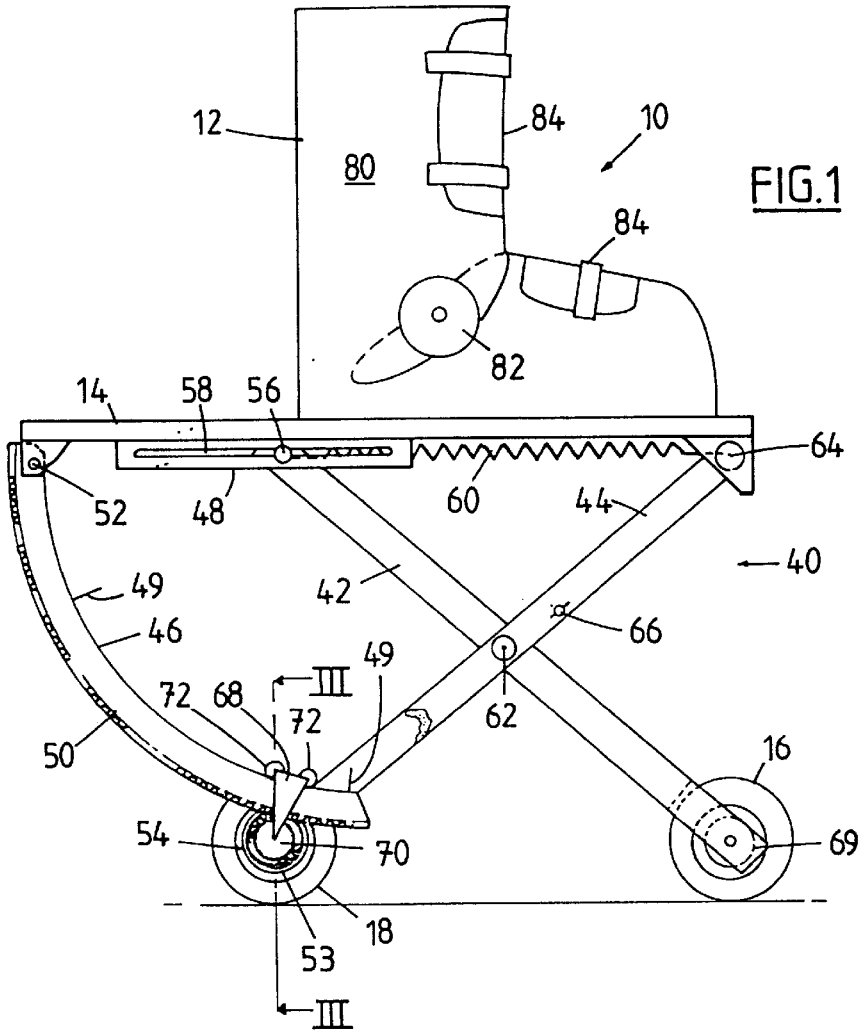
FIG. 1 is a diagrammatic side view of a skate in accordance with an embodiment of the present invention with the skate in an expanded configuration.
Figure 2:
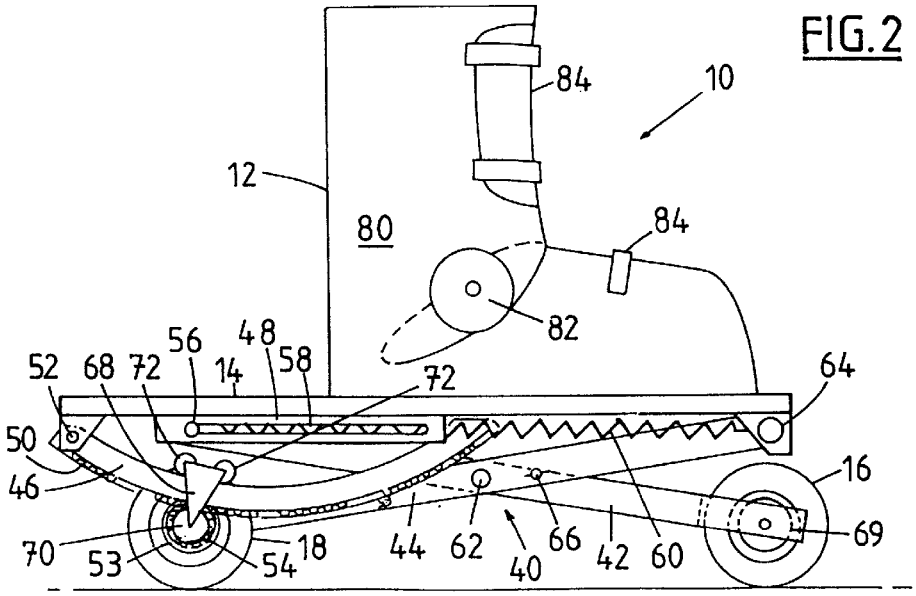
FIG. 2 is a diagrammatic side view of the skate of FIG. 1 with the skate in a contracted configuration.

Referring to FIGS. 1 and 2, there is shown a skate 10 in an expanded configuration and a contracted configuration respectively, the skate 10 including a boot portion having a boot 12 and a base 14, a first wheel 16, a drive wheel 18 and a propulsion means 40. The propulsion means 40 includes a first member 42, a second member 44, a driving mechanism 46, and a slide member 48. The first member 42 is connected by a sliding attachment 56 to the slide member 48. The first member 42 is also connected to the second member 44 at a pivot connection 62. In addition, the first member 42 is also connected to the first wheel 16 by a first bearing set 69. The second member 44 is connected to the base 14 at a pivot connection 64. The second member 44 is also connected to the drive wheel 18 by a second bearing set 70.

In FIGS. 1 and 2, it will be understood that each of the first and second members 42, 44 is configured so as to include a forked portion at a wheel receiving end, each respective wheel being rotatably received between arms of the corresponding forked portion.

The driving mechanism 46 is preferably curve shaped with fine gear teeth 50 on the outside of the curve. The drive wheel 18 includes a sprag bearing in the form of a one way clutch 71 and a pinion 53 with gear teeth 54. The driving mechanism 46 is connected to the base 14 at a pivot connection 52. The gear teeth 50 engage with the gear teeth 54 such that a driving force from the driving mechanism 46 causes the gear teeth 50 to rotate the pinion 53, thereby providing a driving force to cause the drive wheel 18 to rotate.

The first member 42 and the second member 44 move in a scissor like action whereby a downward force applied to the base 14 by a user causes the base 14 to move closer to the first wheel 16 and the drive wheel 18 as the skate moves from the expanded configuration as shown in FIG. 1 to the contracted configuration as shown in FIG. 2. At the same time, as the base 14 moves closer to the first wheel 16 and the drive wheel 18, the driving mechanism 46 moves past the drive wheel 18 and the sliding attachment 56 moves within a slot 58 of the slide member 48 towards the pivot connection 52.

The sliding attachment 56 is connected to the pivot connection 64 by a spring 60. The spring 60 is arranged to apply a force to the first member 42 via the sliding attachment 56 such that the spring 60 biases the sliding attachment 56 towards the pivot connection 64 and thereby the skate towards the expanded configuration.

The one way clutch 71 provides transmission of a driving force in one direction and rotates freely in the other direction. In this way, when the base 14 is moved closer to the wheels 16 and 18, the gear teeth 50 of the driving mechanism 46 engage with the gear teeth 54 of the pinion 53 and the one way clutch 71 transmits the driving force to the wheel 18. Conversely, when the base 14 is moved away from the wheels 16 and 18 as will be described, the one way clutch 71 rotates freely such that the pinion 53 and thereby the driving mechanism 46 is not drivingly engaged with the wheel 18.

Figure 3:
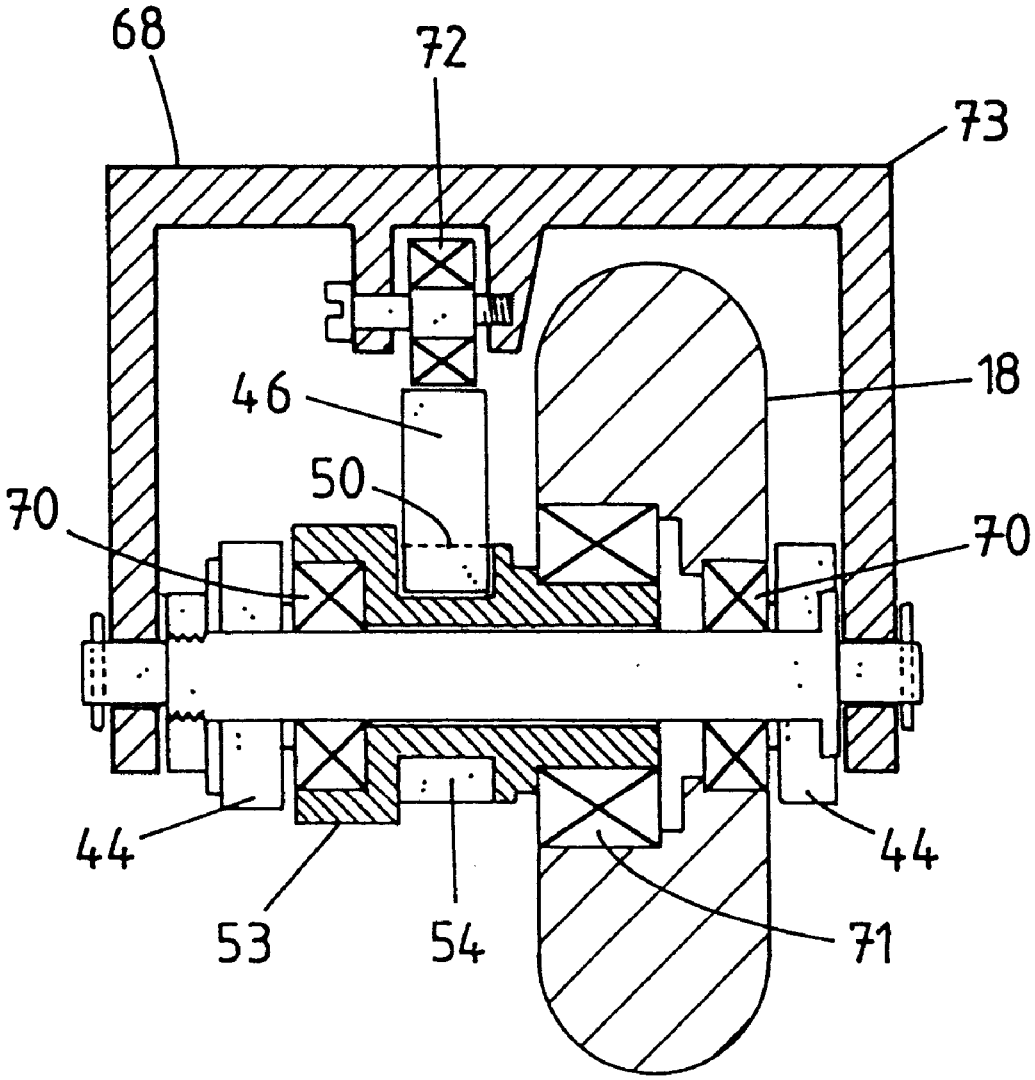
FIG. 3 is a diagrammatic cross-sectional view taken along the line III—III in FIG. 1 in the direction of the arrows.

The driving mechanism 46 is held in engagement with the pinion 53 by a guide means 68 shown in FIG. 3, so as to provide continuous meshing of the gear teeth 50 with the gear teeth 54. The guide means 68 includes a frame 73 and at least one roller 72 rotatably mounted on the frame 73. The rollers 72 of the guide means 68 urge the drive mechanism 46 to engage with the gear teeth 54.

The driving mechanism 46 may include stop members in the form of pins 49 for determining the maximum displacement of the driving mechanism 46 relative to the guide means.

The boot 12 includes rigid side portions 80 on either side to restrict lateral flexibility in the boot 12. A pivoting arrangement 82 allows the boot 12 to bend forward and back. A fastening means 84 is provided to fasten the boot 12 to a foot of a user. The fastening means 84 may be, for example, clips or laces.

Referring to FIG. 2, the skate 10 is shown in the contracted configuration with the propulsion means 40 at the end of a power stroke. A locking means is provided, which may be, for example, a pin 66. The pin 66 may be arranged to manually lock the first member 42 in a fixed position with respect to the second member 44 such that the skate 10 is held in the contracted configuration. This enables the skate 10 to be used in the known fashion.

It will be appreciated that the geometry of the base 14, the first member 42, the second member 44, the first wheel 16 and the drive wheel 18 is such that the first wheel and the drive wheel 18 remain substantially equidistant from the base 14 as the skate 10 moves from the expanded configuration to the contracted configuration. It will also be seen that the angle between the base 14 and a plane passing through the axes of rotation of the first wheel 16 and the drive wheel 18 remains substantially constant as the skate moves from the expanded configuration to the contracted configuration. In this way, the base 14 remains substantially parallel to the ground during use.

The manner of use and operation of the present invention will now be described.

A user puts on a pair of skates of the present invention by placing each foot within a boot 12 and fastening the boot 12 with the fastening means 84.

At the beginning of a power stroke, as seen in FIG. 1, the user applies a downward force through the boot 12 by directing their weight towards the corresponding foot. The downward force causes the base 14 to move closer to the first wheel 16 and the drive wheel 18, the first member 42 and the second member 44 to pivot about the pivot connection 62 and the driving mechanism 46 to rotate the pinion 53. The action of the driving mechanism 46 rotating the pinion 53 has the effect of applying a driving force to the drive wheel 18 which causes the drive wheel 18 to rotate and thus urge the skate to move in a forward direction. Movement of the first member 42 causes the sliding attachment 56 to move away from the pivot point 64 within the slot 58 of the slide member 48, this movement also resiliently loading the spring 60.

At the completion of the power stroke, the skate 10 is as shown in FIG. 2. The boot 12 is lifted and through the force applied by the spring 60 which draws the sliding attachment 56 toward the pivot connection 64, the propulsion means 40 returns to the expanded configuration at the beginning of another power stroke as shown in FIG. 1.

The skate may be used in a normal fashion by using the locking means 66 to lock the skate 10 in the contracted configuration.

It will be appreciated that each of the below described embodiments of the invention is configured such that the geometry of the base 14, the first member, the second member and the wheels causes the wheels to remain substantially equidistant from the base 14 as the skate moves from the expanded configuration to the contracted configuration. It will also be seen that the angle between the base 14 and a plane passing through the axes of rotation of the first wheel 16 and the drive wheel 18 remains substantially constant as the skate moves from the expanded configuration to the contracted configuration. In this way, the base 14 remains substantially parallel to the ground during use.

Figure 4:
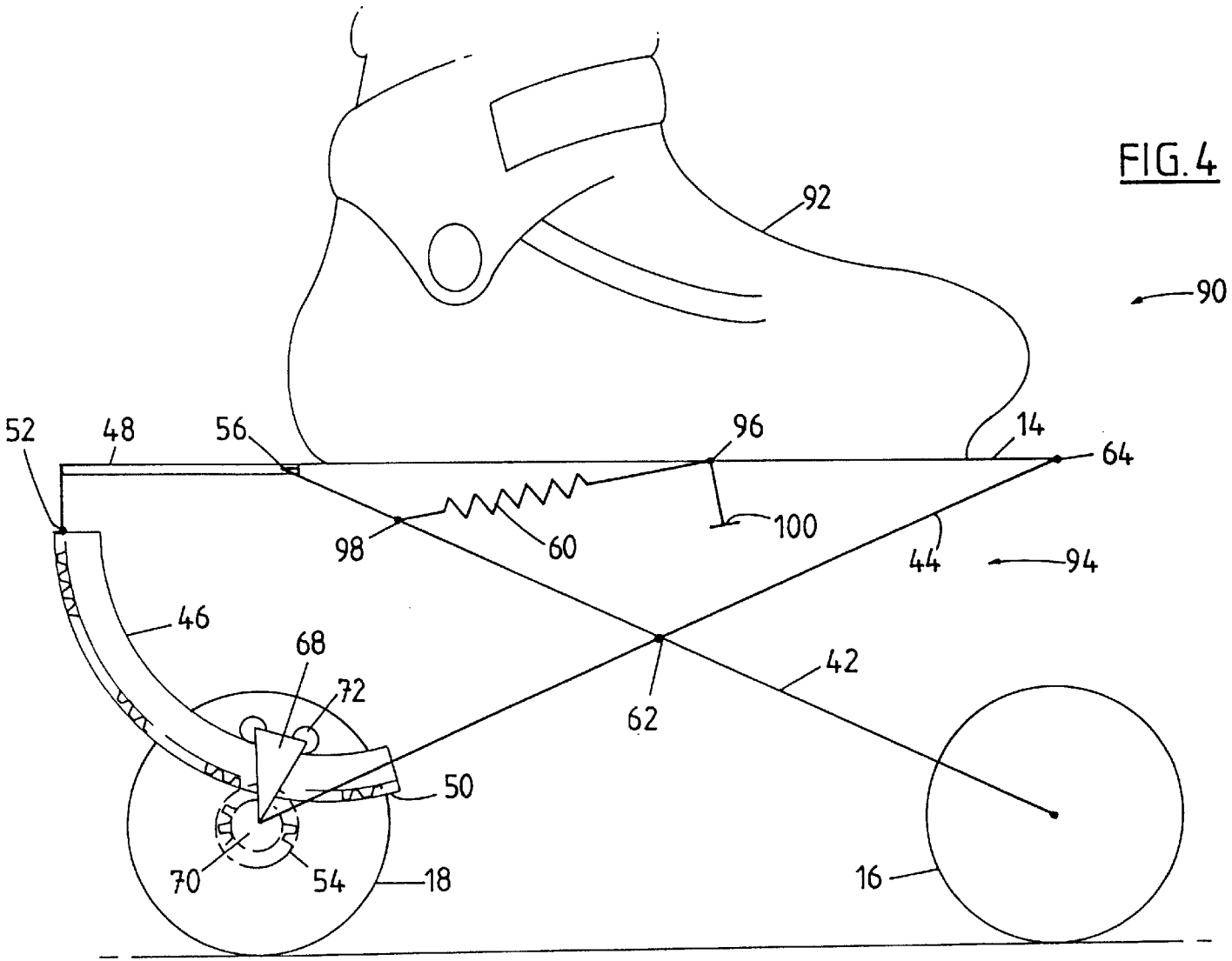
FIG. 4 is a schematic side view of a skate in accordance with another embodiment of the present invention with the skate in an expanded configuration.

An alternative embodiment of the invention is shown in FIG. 4. Like features are indicated by like reference numerals. FIG. 4 shows an alternative skate 90 including an alternative boot 92 and a propulsion means 94. The construction of the propulsion means 94 is the same as the propulsion means 40 shown in FIGS. I and 2 except that the spring 60 is connected between a pivot connection 96 located intermediate the pivot connection 64 and the sliding attachment 56, and a pivot connection 98 located intermediate the sliding attachment 56 and the pivot connection 62. Also provided is a stop member 100 which has the effect of limiting the maximum displacement of the boot 92 from the extended configuration as the boot moves from the extended configuration to the contracted configuration. The stop member 100 may also serve to hold the skate 90 in the contracted configuration in a similar manner to the locking means of the embodiment shown in FIGS. 1 and 2.

Figure 5:
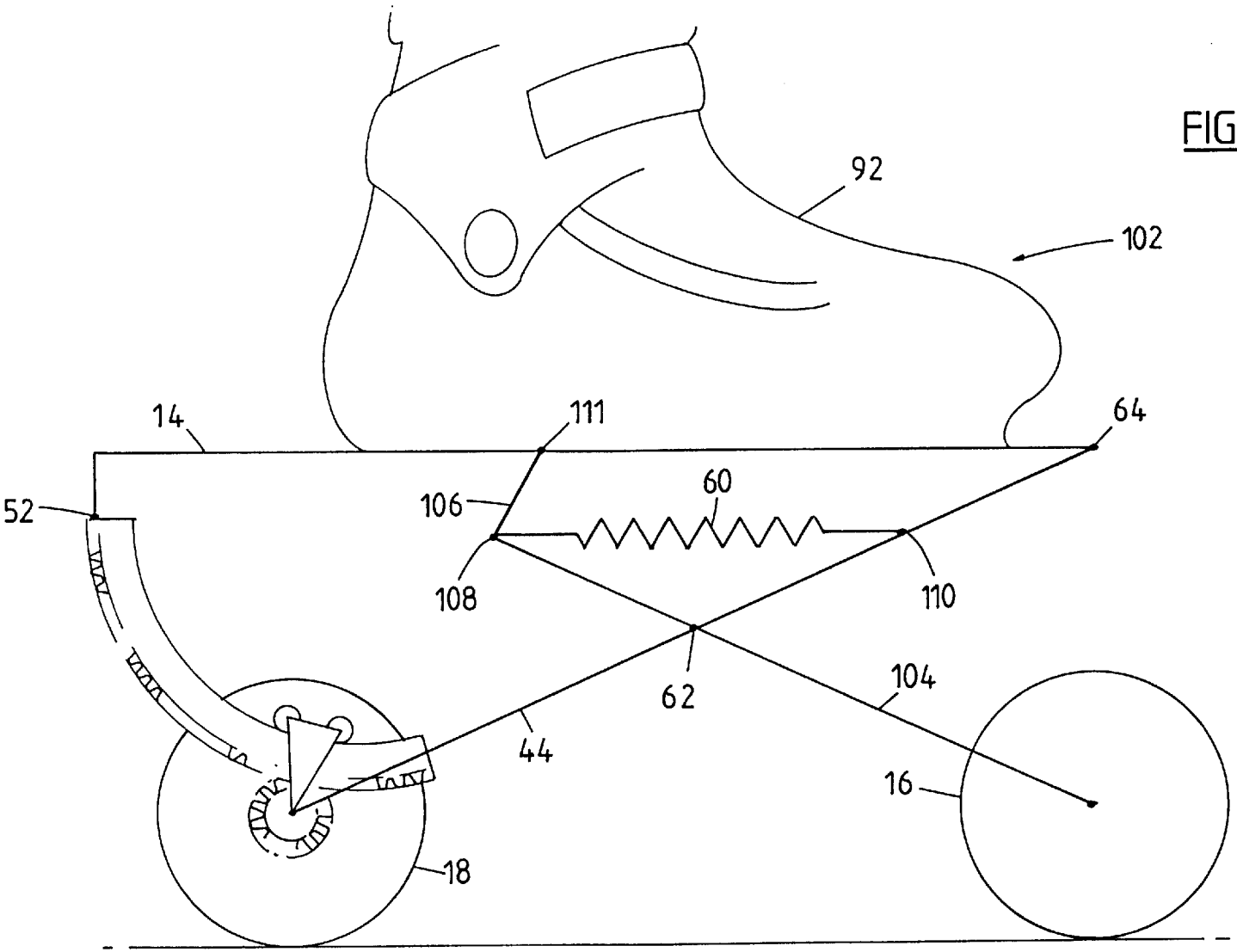
FIG. 5 is a schematic side view of a skate in accordance with a further embodiment of the present invention with the skate in an expanded configuration.

In FIG. 5, there is shown a skate 102 in accordance with a further embodiment of the present invention with the skate 102 in an expanded configuration. Like features have been indicated with like reference numerals.

The skate 102 includes a first member 104 rotatably connected at one end thereof to the first wheel 16 and pivotably connected at the other end thereof to a radius arm 106 at a pivot connection 108. The spring 60 extends between the pivot connection 108 and a pivot connection 110 on the second member 44 intermediate the pivot connection 62 and the pivot connection 64. The radius arm 106 is connected to the base 14 at a pivot connection 111.

The arrangement of this embodiment is such that as the skate moves from the expanded configuration as shown in FIG. 5 to a contracted configuration and the first wheel 16 and the drive wheel 18 move towards the base 14, the radius arm 106 rotates about the pivot connection 111 in a clockwise direction. At the same time, the spring 60 expands thereby resiliently biasing the skate 102 towards the expanded configuration.

Figure 6:
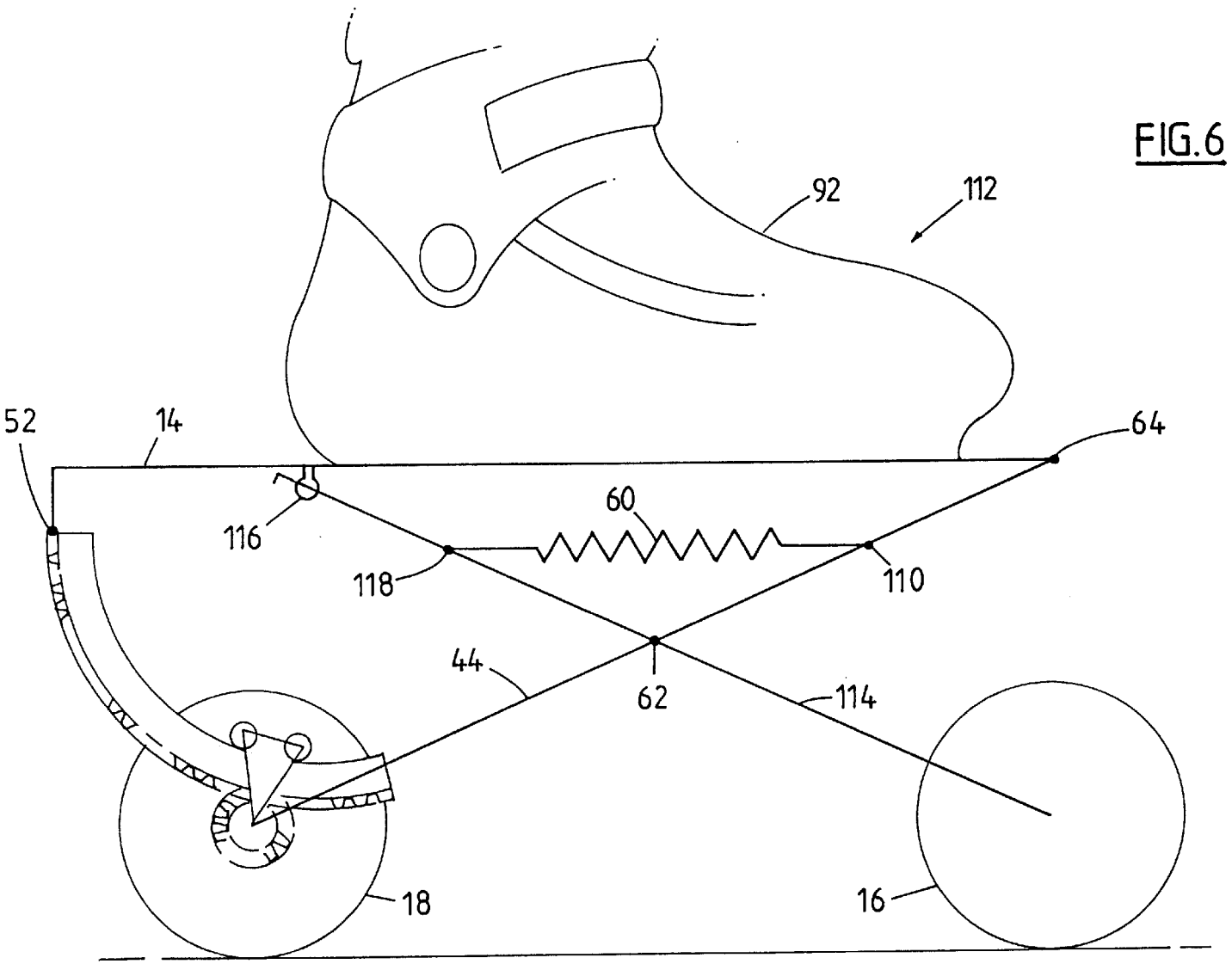
FIG. 6 is a schematic side view of a skate in accordance with a still further embodiment of the present invention with the skate in an expanded configuration.

In FIG. 6, there is shown a skate 112 in accordance with a still further embodiment of the present invention with the skate 112 in an expanded configuration. Like features have been indicated with like reference numerals.

The skate 112 includes a first member 114 rotatably connected at one end thereof to the first wheel 16 and slidably connected at the other end thereof to a sliding connection member 116 located adjacent the base 14. In this embodiment, the spring 60 extends between the pivot connection 110 on the second member 44 to a pivot connection 118 on the first member 114 intermediate the pivot connection 62 and the sliding connection member 116.

The arrangement of this embodiment is such that as the skate moves from the expanded configuration as shown in FIG. 6 to a contracted configuration, the first member 114 slides and rotates relative to the sliding connection member 116, the pivot connection 118 moves towards the sliding connection member 116 and the spring expands and thereby biases the skate 112 towards the expanded configuration.

It will be appreciated that with this embodiment of the invention, it is necessary to locate the sliding connection member 116 at a specifically determined location relative to the base 14 such that the first wheel 16 and the drive wheel 18 remain substantially equidistant from the base 14 as the skate 112 moves from the expanded configuration to the contracted configuration.

Figure 7:
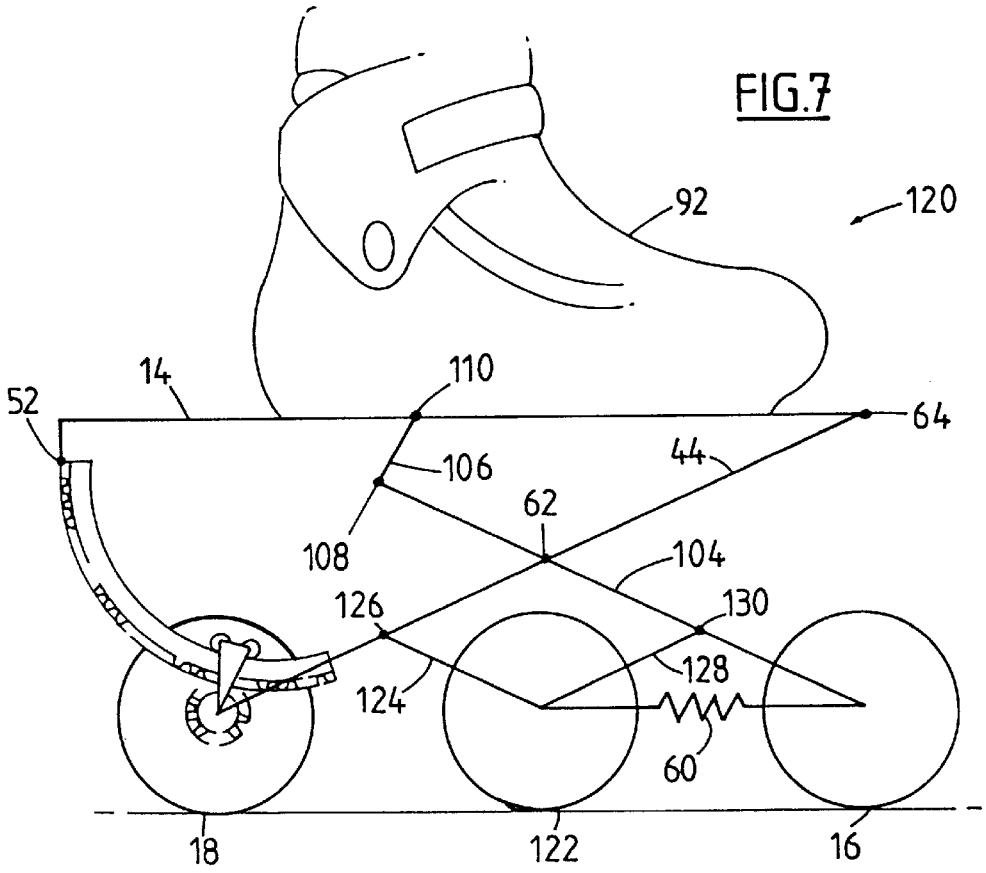
FIG. 7 is a schematic side view of a skate in accordance with a still further embodiment of the present invention with the skate in an expanded configuration.
Figure 8:
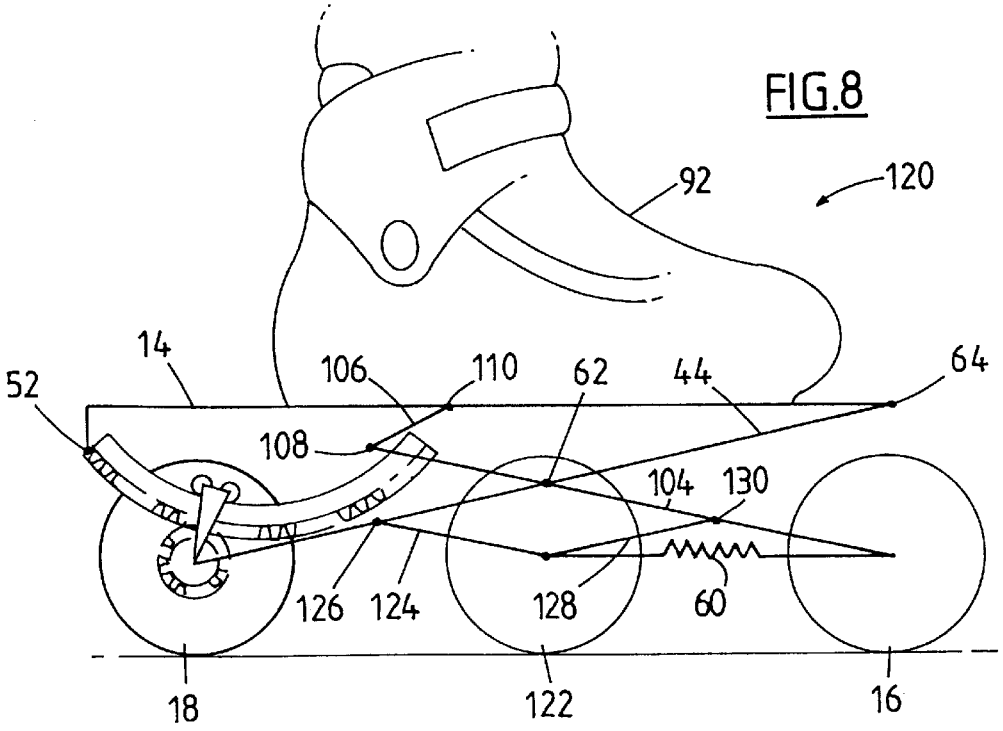
FIG. 8 is a schematic side view of the skate shown in FIG. 7 with the skate in a contracted configuration.

FIGS. 7 and 8 show a skate 120 in accordance with a still further alternative embodiment of the present invention with the skate 120 in an expanded and a contracted configuration respectively. Like features have been indicated with like reference numerals.

This embodiment is similar to the embodiment shown in FIG. 5 in that the geometry of the skate 120 is maintained by virtue of a radius arm 106. The skate 120 includes a second wheel 122 disposed intermediate the first wheel 16 and the drive wheel 18. The second wheel 122 is rotatably mounted on a bearing set (not shown) which may be similar to the first bearing set 69. The skate 120 is provided with a third member 124 pivotably connected at one end thereof to the second wheel 122 and pivotably connected at the other end thereof to the second member 44 at a pivot connection 126 intermediate the pivot connection 62 and the drive wheel 18. Also provided is a fourth member 128 pivotably connected at one end thereof to the second wheel 122 and pivotably connected at the other end thereof to a pivot connection 130 intermediate the pivot connection 62 and the first wheel 16. The arrangement is such that the first, second, third and fourth members 104, 44, 124, 128 define a parallelogram with the second wheel 122 located at a vertex of the parallelogram. In this embodiment, the spring 60 extends between the axis of rotation of the first wheel 16 and the axis of rotation of the second wheel 122.

The arrangement is also such that the first wheel 16, the second wheel 122 and the drive wheel 18 remain substantially equidistant from the base 14 as the skate 120 moves from the expanded configuration shown in FIG. 7 to the contracted configuration shown in FIG. 8.

Figure 9:
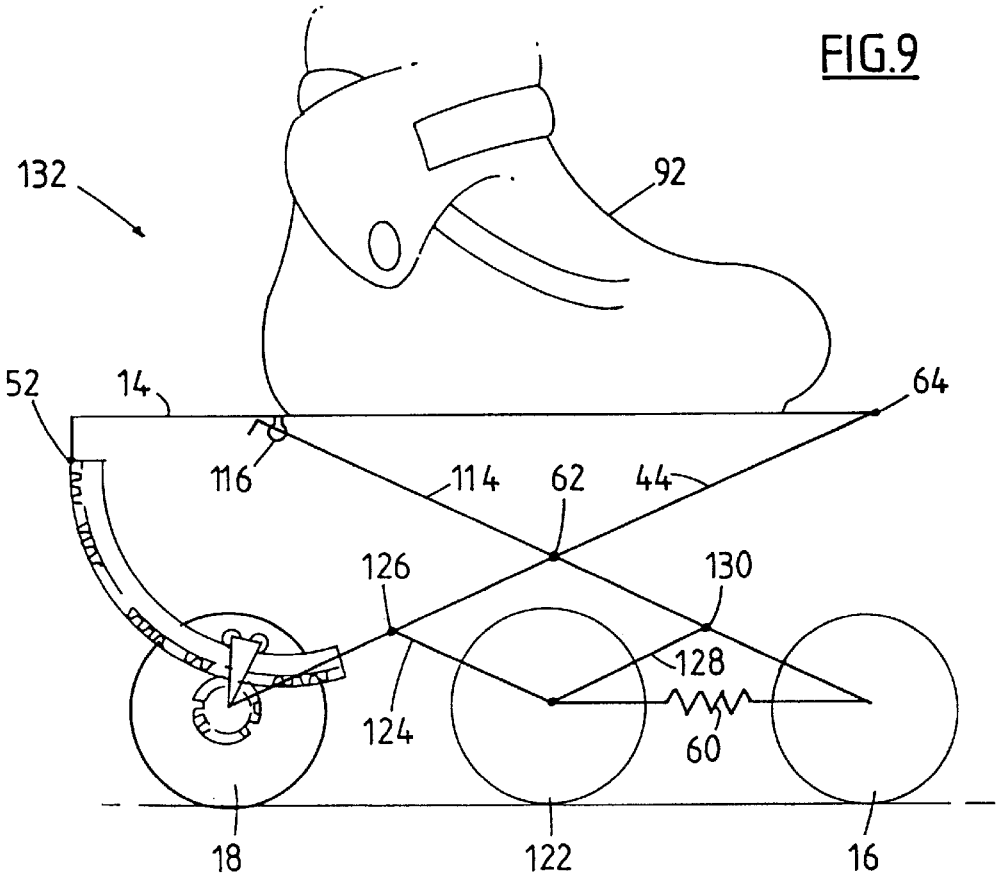
FIG. 9 is a schematic side view of a skate in accordance with a still further embodiment of the present invention with the skate in an expanded configuration.
Figure 10:
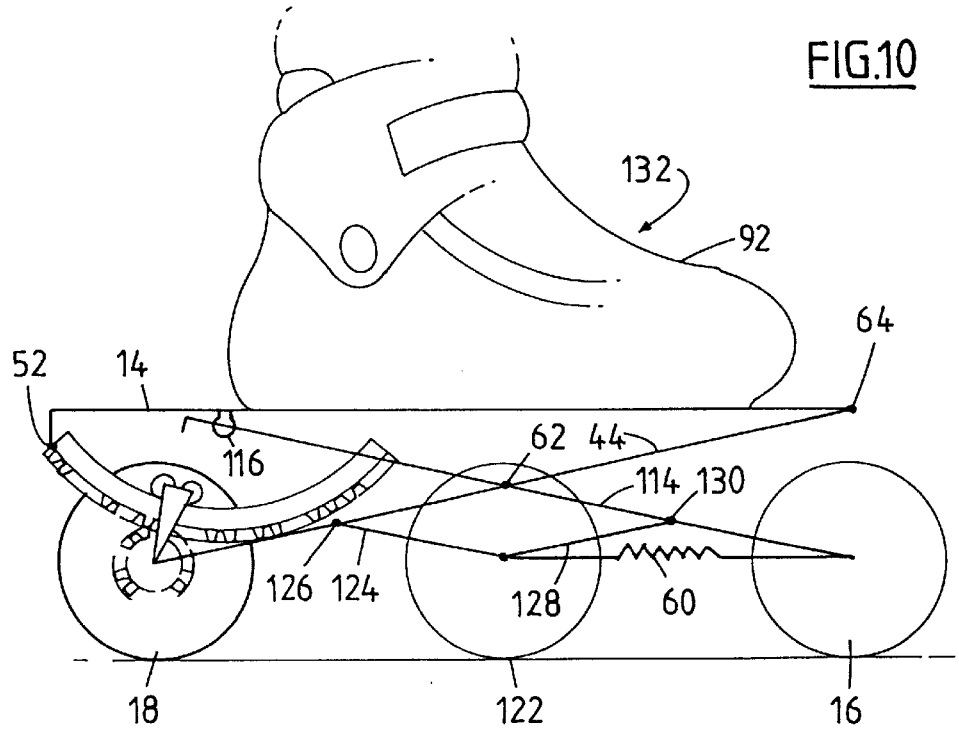
FIG. 10 is a schematic side view of the skate shown in FIG. 9 with the skate in a contracted configuration.

In FIGS. 9 and 10, there is shown a still further embodiment of a skate 132 in accordance with the present invention with the skate 132 in an expanded and a contracted configuration respectively. Like reference numerals have been used to indicate like features.

This embodiment is similar to the embodiment shown in FIGS. 7 and 8 except that the skate 132 includes the first member 114 and the sliding connection member 116 of the embodiment shown in FIG. 6. Accordingly, in order for the wheels to remain substantially equidistant from the base 14, it is necessary to locate the sliding connection member 116 at a specifically determined location relative to the base 14.

Figure 11:
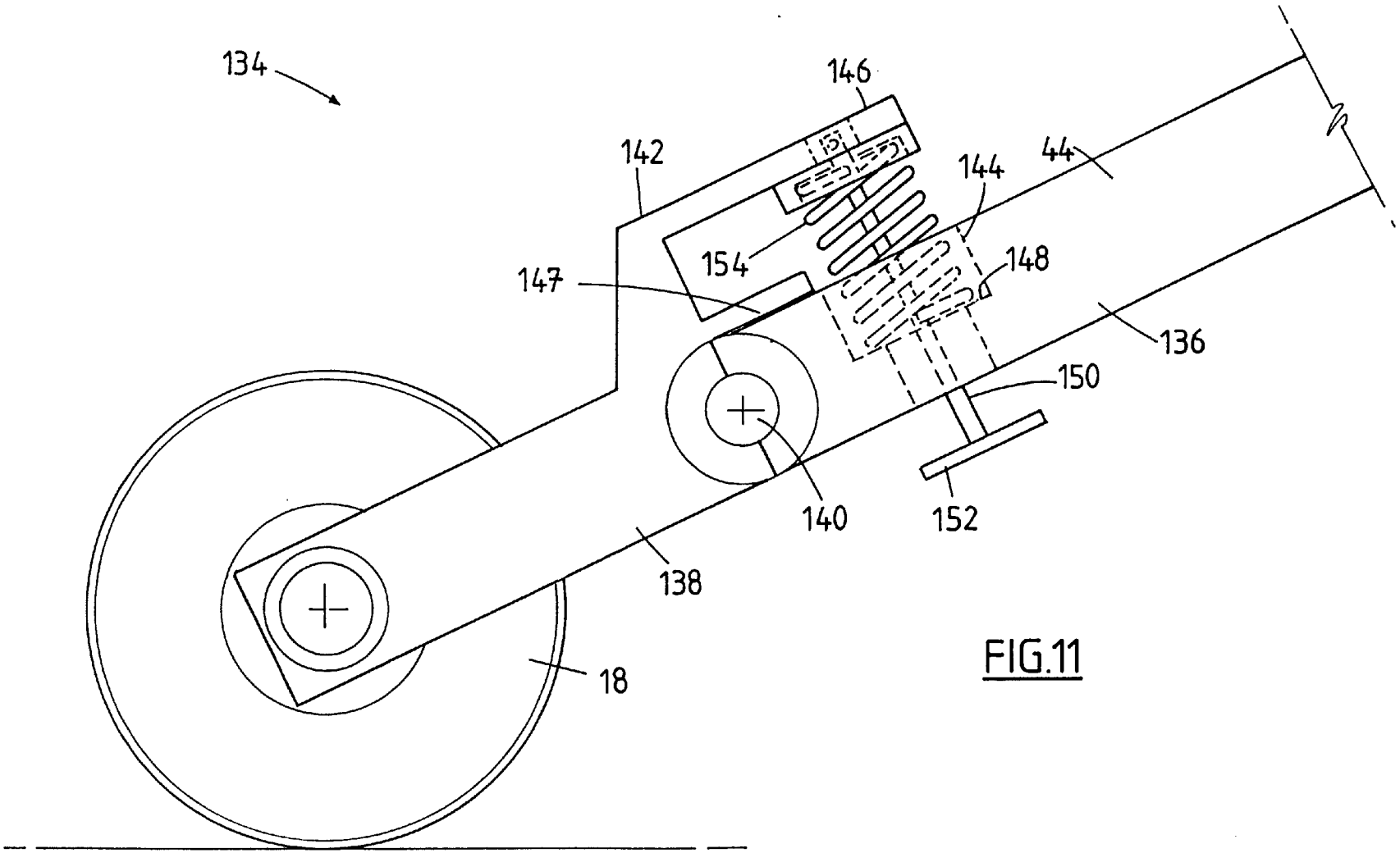
FIG. 11 is a diagrammatic side view of a traction control mechanism of a skate in accordance with the present invention.

In FIG. 11, there is shown a traction control mechanism 134 which is adapted to form part of a lower end portion of the second member 44. The traction control mechanism 134 is particularly applicable to the embodiments shown in FIGS. 7 to 10.

The traction control mechanism 134 includes a first arm portion 136 and a second arm portion 138 pivotably connected to the first arm portion 136 at a pivot connection 140.

The second arm portion 138 is provided with a flange portion 142 having an end portion 146 and a stop member 147, the flange portion 142 extending away from the drive wheel 18 to a location adjacent and above the first arm portion 136. The first arm portion 136 includes an aperture 144 located adjacent and below the end portion 146, the aperture 144 including a step portion 148.

The traction control mechanism 134 also includes a substantially T-shaped member 150 pivotably connected to the end portion 146 of the flange portion 142, the T-shaped member extending downwardly of the flange portion through the aperture 144. A cross member 152 of the T-shaped portion is disposed on an opposite side of the second member to the flange portion 142 to limit rotation of the second arm portion 138 about the pivot connection in a first sense. Disposed intermediate the flange portion 142 and the step portion 148 is a spring 154, the spring 154 serving to bias the flange portion 142 away from the first arm portion 136 and thereby the drive wheel 18 towards the ground in use.

The pivot connection 140 is configured such that rotation of the second arm portion 138 about the pivot connection 140 in a second sense opposite to the first sense is limited by the stop member 147 to an orientation whereby the first and second arm portions 136, 138 are parallel, as shown in FIG. 11.

The arrangement of the traction control mechanism 134 is such that the second arm portion 138 is free to rotate about the pivot connection 140 in response, for example, to an uneven road surface, between an orientation whereby the cross-member 152 contacts the first arm portion 136 and an orientation whereby the stop member 147 contacts the first arm portion 136. The drive wheel 18 is urged to remain in contact with the ground in use by the spring 154.

Figure 12:
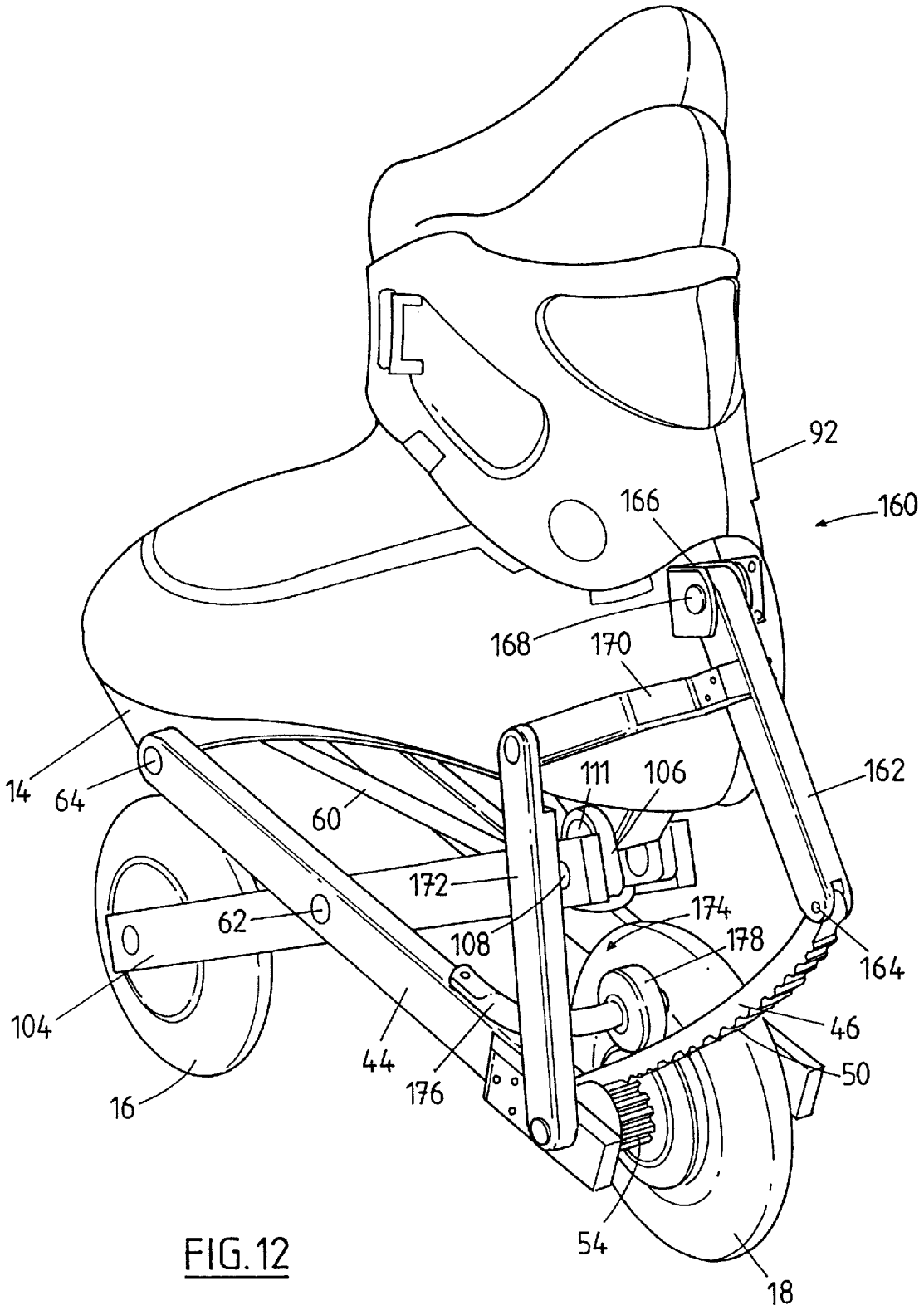
FIG. 12 is a diagrammatic perspective view of a skate in accordance with a still further embodiment of the present invention.

In FIG. 12 there is shown a still further embodiment of a skate 160 in accordance with the present invention with the skate 160 in an expanded configuration. Like reference numerals have been used to indicate like features.

The configuration of the skate 160 is similar to the embodiment of the invention shown in FIG. 5 in that a radius arm 106 is provided to facilitate contraction of the skate 160. The skate 160 is provided with a first link 162 rotatably connected at one end to a rear surface of the boot 92 at a bracket 166 and rotatably connected at the other end to the driving mechanism 46 at a pivot connection 164. The first link 162 is rotatably connected to the bracket 166 at a pivot connection 168. Also provided is a second link 170 fixedly connected to the first link 162 by any suitable means, in this example the second link 170 being fixedly connected at one end to the first link 162 adjacent the bracket 166. Also provided is a third link 172 rotatably connected to the second link 170 at one end and rotatably connected at the other end to the second member 44 at an end of the second member 44 remote from the boot 92. The arrangement is such that the second and third links 170, 172 act to ensure that as the skate 160 moves from the expanded configuration as shown in FIG. 12 to a contracted configuration, the driving mechanism 46 moves towards the drive wheel 18.

As an alternative, for extra strength the first 162 and second 170 links may be formed as one piece of substantially triangular shaped material, the triangular piece having a stub link extending from an apex of the triangle and being pivotably connected to the bracket 166.

In this embodiment, an alternative guide means 174 is provided which includes an arm member 176 fixedly mounted on the second member 44 at one end and a roller 178 rotatably mounted on the arm member 176 at the other end. The guide means 174 operates in a similar way to the guide means 68 shown in the previously described embodiments in that the roller 178 acts to urge the driving mechanism 46 to engage with the gear teeth 54. Shims may also be provided between the arm member 176 and the second member 44 so as to adjust the position of the roller 178 relative to the driving mechanism 46 as desired.

It is envisaged that two first wheels may be provided instead of the above described single first wheel, the first wheels being mounted on the same axis of rotation and being rotatable about a substantially vertical axis perpendicular to the axis of rotation of the wheels. In this way, the direction of movement of the skate could be controlled by a user by appropriate distribution of weight and corresponding rotation of the first wheels about the vertical axis.

It will be appreciated that features of the above embodiments are interchangeable and the applicant is not restricted to the specific embodiments described. For example, the embodiment of the invention shown in FIG. 12 may include three wheels connected in a manner similar to the embodiments shown in FIGS. 7 to 10, and may include the traction control mechanism shown in FIG. 11, or the embodiments shown in FIGS. 1, 2 and 4 to 10 may include first 162, second 170 and third 172 links and a bracket for connecting the driving mechanism to the rear of the boot as shown in FIG. 12.

It will be appreciated that as well as obtaining propulsion by conventional action, the present invention also provides propulsion by transferring a proportion of a downward force applied to the skates to a forward propulsion force.

It will also be appreciated that, because of the geometry of the skates, in each embodiment described above, the first wheel remains in substantially the same vertical plane as the skate moves from the expanded configuration to the contracted configuration, the drive wheel (and the second wheel, if appropriate) at the same time moving away from the first wheel.

It will also be appreciated that gear wheels may be provided intermediate the driving mechanism 46 and the pinion 53 to achieve the desired gear ratio between the driving mechanism 46 and the pinion.

It will also be appreciated that the thickness of the driving mechanism 46 is such that the distance between the roller 72, 178 and the portion of the pinion 53 which engages with the driving mechanism 46 remains substantially constant as the drive member 46 moves towards and away from the drive wheel 18. In this way, smooth transfer of force between the driving mechanism 46 and the pinion 53 is obtained.

Furthermore, it will be appreciated that the skate may include a stop member (not shown) to limit expansion of the skate and prevent disengagement of the drive member 46 from the pinion 53. A stop member (not shown) may also be provided to restrict contraction of the skate.

Modifications and variations as would be apparent to a skilled addressee are deemed to be within the scope of the present invention.

What is claimed is:

1. A skate including a boot portion having a base portion and a boot, a first member pivotably connected at an upper longitudinal end thereof to the base portion, a second member pivotably connected at an upper longitudinal end thereof to the base portion and pivotably connected to the first member, a first wheel mounted on the first member at a lower longitudinal end thereof, a drive wheel mounted on the second member at a lower longitudinal end thereof, the drive wheel having a concentrically mounted pinion, and an elongate driving mechanism pivotably connected to the boot portion and adapted to operatively engage with the pinion, the skate being movable between an expanded configuration wherein the base portion is spaced from the first wheel and the drive wheel and a contracted configuration wherein the base portion is adjacent the first wheel and the drive wheel, the arrangement being such that when the skate moves from the expanded configuration to the contracted configuration, the base portion remains substantially parallel to a plane passing through the axes of rotation of the first wheel and the drive wheel and the driving mechanism effects rotation of the pinion and thereby transfers a propulsion force to the drive wheel.

2. A skate as claimed in claim 1, wherein the said upper longitudinal end of the first member is provided with a sliding attachment, and the skate further includes a slide member connected to the base portion, the slide member having a longitudinal slot adapted to slidably receive the sliding attachment.

3. A skate as claimed in claim 1, further including an elongate radius arm pivotably connected at one end thereof to the said upper longitudinal end of the first member and pivotably connected at the other end thereof to the base portion.

4. A skate as claimed in claim 1, further including a sliding connection member connected to the base portion, the said upper end of the first member being slidably and rotatably engaged with the sliding connection member so as to facilitate translational and rotational movement of the first member relative to the sliding connection member.

5. A skate as claimed in claim 1, wherein the driving mechanism is substantially curve shaped, the driving mechanism being provided on an outer arcuate surface with a plurality of gear teeth adapted to engage with gear teeth on the pinion.

6. A skate as claimed in claim 1, further including guide means having a frame pivotably mounted on the axis of rotation of the drive wheel, the frame being provided at a location spaced from the axis of rotation of the gear wheel with a guide member configured and located relative to the driving mechanism so that the guide member acts to urge the gear teeth of the driving mechanism to continuously contact gear teeth of the pinion as the skate moves from the expanded configuration to the contracted configuration.

7. A skate as claimed in claim 1, further including guide means having an arm member mounted on the second member, the arm member being provided at an end thereof remote from the second member with a guide member configured and located relative to the driving mechanism so that the guide member acts to urge the gear teeth of the driving mechanism to continuously contact gear teeth of the pinion as the skate moves from the expanded configuration to the contracted configuration.

8. A skate as claimed in claim 7, further including at least one shim between the arm member and the second member.

9. A skate as claimed in claim 6 or claim 7, wherein the guide member is a roller.

10. A skate as claimed in claim 1, further including means for biasing the skate towards the expanded configuration.

11. A skate as claimed in claim 10, wherein the said means for biasing the skate towards the expanded configuration is a spring.

12. A skate as claimed in claim 11, wherein the spring extends between the first member and the second member.

13. A skate as claimed in claim 11, wherein the spring extends between the base portion and the first member or the second member.

14. A skate as claimed in claim 1, further including at least one second wheel connected to the first member and the second member.

15. A skate as claimed in claim 1, further including a traction control mechanism having a first arm portion and a second arm portion remote from the base portion and pivotably connected to the first arm portion, the first arm portion and the second arm portion forming the second member, and the second arm portion being resiliently biased, in use, towards the ground.

16. A skate as claimed in claim 15, wherein the second arm portion includes a flange portion extending above the first arm portion and the first arm portion includes an aperture located below the flange portion, the aperture having a step portion and a biasing spring being located between the step portion and the flange portion.

17. A skate as claimed in claim 16, wherein the traction control mechanism further includes a T-shaped member pivotably connected at one end thereof to the flange portion, the T-shaped member extending through the aperture such that a cross member of the T-shaped member locates on a side of the first arm member remote from the flange portion, the cross member acting to limit rotational movement of the second arm portion in a first sense.

18. A skate as claimed in claim 16 or claim 17, wherein the flange portion is provided with a stop member adapted to contact the first arm portion and thereby limit rotational movement of the second arm portion in a second sense opposite to the first sense.

19. A skate as claimed in claim 1, wherein the driving mechanism is pivotably connected to a rear portion of the boot.

20. A skate as claimed in claim 1, further including means for ensuring that the driving mechanism moves towards the drive wheel as the skate moves from the expanded configuration to the contracted configuration.

21. A skate as claimed in claim 20, wherein the said means includes a first link pivotably connected at one end to the driving mechanism and pivotably connected at the other end to the boot, and a second link connected at one end to the first link and pivotably connected at the other end to a third link, the third link being pivotably connected to the second member.

22. A skate as claimed in claim 20, wherein the said means includes a substantially triangular shaped member pivotably connected at a first apex to the boot, pivotably connected at a second apex to the driving member and pivotably connected at a third apex to a link, the link being pivotably connected to the second member.

23. A skate as claimed in claim 1, wherein the pinion is operatively connected to the drive wheel by a one way clutch, the pinion locating adjacent and being rotatably mounted on an axle associated with the drive wheel.

24. A skate as claimed in claim 23, wherein the one way clutch is substantially annular and a portion of the pinion locates adjacent an inner circumferential surface of the one way clutch.

25. A skate as claimed in claim 1, further including stop means adapted to limit expansion of the skate.

26. A skate as claimed in claim 1, further including stop means adapted to limited contraction of the skate.

* * * * *